US006116142A

United States Patent [19]

Bunge

[11] Patent Number: 6,116,142

[45] Date of Patent: Sep. 12, 2000

[54] CONTROLLER FOR A FLUID CYLINDER

[75] Inventor: Georg Bunge, Meerbusch, Germany

[73] Assignee: Parker Hannifin GmbH, Koln, Germany

[21] Appl. No.: 09/214,326

[22] PCT Filed: Jul. 2, 1997

[86] PCT No.: PCT/DE97/01384

§ 371 Date: Jan. 4, 1999

§ 102(e) Date: Jan. 4, 1999

[87] PCT Pub. No.: WO98/01677

PCT Pub. Date: Jan. 15, 1998

[30] Foreign Application Priority Data

Jul. 5, 1996 [DE] Germany ..... 196 27 086

[51] Int. Cl.[7] ..... F15B 13/04

[52] U.S. Cl. ..... 91/436

[58] Field of Search ..... 91/32, 436, 437, 91/464

[56] References Cited

U.S. PATENT DOCUMENTS 3,273,468 1/1965 Allen ..... 91/436
3,357,451 12/1967 Tennis .
3,858,485 1/1975 Rosaen et al. .
4,840,111 6/1989 Garnjost .

FOREIGN PATENT DOCUMENTS 30 00 260 A1 7/1981 Germany .
3000260 7/1981 Germany .
423 4647 C1 1/1994 Germany .
2 199 115 6/1988 United Kingdom .

*Primary Examiner*—Edward K. Look
*Assistant Examiner*—Thomas E. Lazo
*Attorney, Agent, or Firm*—John A. Molnar, Jr.

[57] ABSTRACT

A device is disclosed for controlling a double-effect working cylinder (10) having a piston (11) with a piston rod (12) on a single side by means of a multiple-way valve (19), in which the available forces are to be fully applied in the extended end position of the piston rod (12). The multiple-way valve (19) has seven connection openings (P, A1, A2, B1, B2, T1, T2) for controlling the predetermined function, which can be driven in the individual working position by means of a corresponding valve piston (20).

16 Claims, 1 Drawing Sheet

CONTROLLER FOR A FLUID CYLINDER

BACKGROUND OF THE INVENTION

The invention relates to an apparatus for controlling a double-acting working cylinder having a piston with one-sided piston rod by means of a multiway valve, which supplies the working medium to one of the differently sized swept volumes of the working cylinder, respectively, and permits it to flow out of the other swept volume during the piston stroke. The multiway valve, which is designed in the manner of a piston valve, has a pump connection P, a connection A1 for an inflow and outflow line between the large swept volume of the working cylinder and the multiway valve, a connection B1 for an inflow and outflow line between the small swept volume of the working cylinder and the multiway valve, a connection A2 for a connecting line connected to the inflow and outflow line positioned between connection A1 and the large swept volume of the working cylinder, and two reservoir connections T1, T2. The valve piston of the multiway valve has at least five control edges disposed on ring collars and the connections P, A1, A2, B1, T1, T2 are disposed in such a way that as the piston is extended, to use the differential action of the working cylinder with rapid piston motion, connection B1 is connectable with connection A2 and, as the piston is retracted, connection A1 is connectable with T1 and connection A2 with T2, whereby at the end of the differential motion with extended piston rod of the working cylinder, connection B1 is connectable to a line leading to the reservoir to build up force.

DE 30 00 260 C2 describes an apparatus with the aforementioned characteristics. The circuit arrangement disclosed therein, which assigns six connections in series of the multiway valve employed, is intended on the one hand to permit travel of the working cylinder piston with differential action, i.e., with rapid piston stroke, and on the other hand to ensure as compact a structural design of the multiway valve as possible with uniform pressurization of the five control edges provided on the multiway valve with the same quantity of working medium in both travel directions of the piston of the working cylinder.

For this purpose, in the known apparatus, as the working cylinder piston is extended, the additional connection opening connected to the large swept volume of the working cylinder via the connecting line, is connected with the line acting as the outflow from the small swept volume via an associated control edge, which controls only the flow of working medium passing through this connecting line. At the same time, via another control edge and thus independently from the flow path between the swept volumes of the working cylinder, the pump connection is connected to the inlet of the large swept volume of the working cylinder. At the same time, as the piston of the working cylinder is retracted, the connection with the reservoir can be established through an additional connection provided in the multiway valve.

To effect the forward motion of the working cylinder piston utilizing the differential action of the cylinder while using the full force in the extended end position of the piston rod, a directional control valve with two switch positions is additionally placed in the connecting line. When the piston rod is in its extended position, the directional control valve switches to a position where the connection between the small swept volume and the large swept volume, which is provided by the interconnection of connections B1, A1, is interrupted and the small swept volume of the working cylinder is connected to the reservoir. In this position of the directional control valve, the pressure acting on the large area of the piston of the working cylinder is no longer counteracted by a pressure in the small swept volume of the working cylinder such that the holding force is doubled compared to the state existing during extension of the piston rod.

The disadvantage of this known embodiment is that the additional directional control valve adds complexity to the corresponding design of the control apparatus. This is particularly true because the directional control valve must be designed for the same rated quantity as the multiway valve, which serves as the main control of the working cylinder, since the addressed functional case of connecting the small swept volume with the reservoir requires the same flow of working medium to be directed through the directional control valve as through the multiway valve.

SUMMARY OF THE INVENTION

Thus, it is the object of the invention further to develop a control apparatus for a differential cylinder with the initially mentioned characteristics such that the additional directional control valve can be eliminated while the function of a force buildup with extended piston rod is maintained.

The invention is based on the fact that an additional connection B2 is provided for an additional connecting line connected to the inflow and outflow line located between connection B1 and the small swept volume of the working cylinder and that the six control edges formed on the ring collars of the valve piston are assigned to the seven connections P, A1, A2, B1, B2, T1, T2 of the multiway valve such that in the valve-piston position defined for the extension of the piston rod with differential action, the additional connection B2 is connected with A2 if connection B1 is blocked and that the ring collar blocking the connection B1 has an effective overlap via the motion corresponding to the differential motion of the piston and the associated control edge unblocks the connection between connections B1, T2 only after traveling past the valve-piston position corresponding to the end of the differential motion, whereby a non-return valve, which opens the connecting line in the direction of connection B2 and blocks it in the direction of the working cylinder, is interposed in the connecting line that is connected to B2.

The advantage of the invention is that forming an additional seventh connection opening in the multiway valve itself and adapting the design of the valve piston makes it possible to eliminate the additional directional control valve required in the type-determining prior art, since the function of the directional control valve, both with respect to forming an additional reservoir connection and with respect to the instant when this additional reservoir connection becomes effective, is integrated in the multiway valve itself. While the prior art multiway valve has five control edges for controlling the two connections of the working cylinder, the multiway valve according to the invention is distinguished by six control edges formed on the valve piston and an additional seventh control edge in the form of the non-return valve. This additional seventh connection opening increases the size of the multiway valve only insignificantly. The additional cost for the non-return valve, which is a simple, commercially available component, is also very minor.

According to an exemplary embodiment of the invention, the multiway valve has seven ports P, A1, A2, B1, B2, T1, T2, which communicate, respectively, with a ring channel. Starting at the non-blocked valve end, port T1 leads to the reservoir, A1 to the large swept volume, P to the pump, B1 to the small swept volume, T2 to the reservoir, A2 to the connecting line, and B2 to the connecting line. In the central position of the valve piston, the ring collars are assigned to each second opening and the associated ring channel.

BRIEF DESCRIPTION OF THE DRAWING

The drawing depicts an exemplary embodiment of the invention, which is described below.

DETAILED DESCRIPTION OF THE INVENTION

Figure 1:
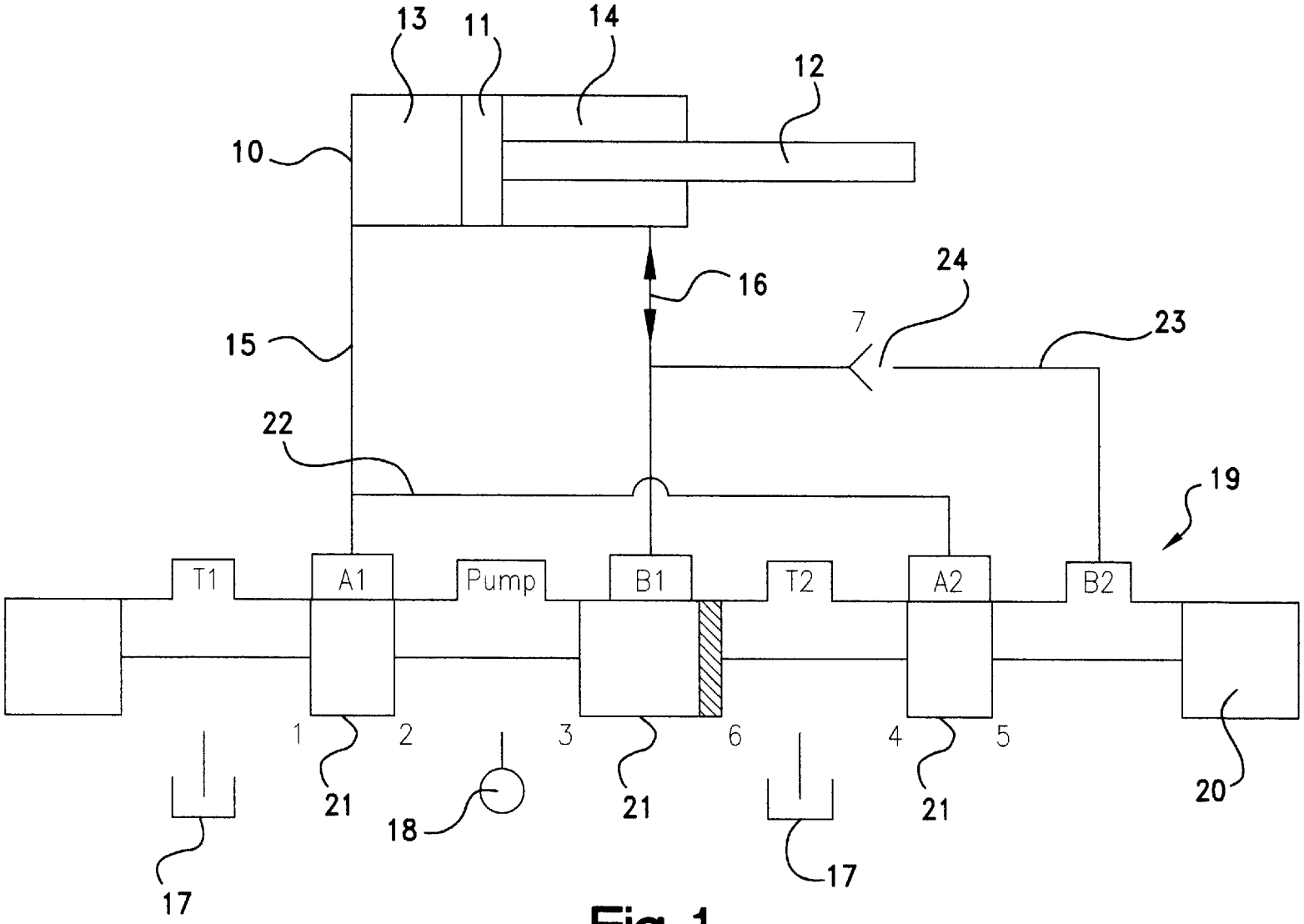

The single FIGURE shows a hydraulic circuit diagram for controlling a differential cylinder including the switching of the multiway valve provided with seven connection openings. The drawing shows only the initial position for the following functional explanation in order to give a rough indication and does not take into account the scale of the openings and the ring collars. It is left to the person of average skill in the art to define the design layout and select the dimensions knowing the functional interrelationships intended by the invention.

The differential cylinder comprises a working cylinder 10 and a piston 11 sliding therein, which has different areas on its two sides, and a piston rod 12. Piston 11 separates the working cylinder 10 into a large swept volume 13 and a small swept volume 14. Each swept volume 13, 14 is provided at its end with a respective inflow and, simultaneously, outflow line 15 and 16 for the working medium, hereinafter referred to as oil by way of example. The oil is located in a reservoir 17 (depicted in separate parts) and is assigned to a multiway valve 19 by means of a pump 18. From there, depending on the position of the valve piston 20, it flows to differential cylinder 10 or through connected outlet lines to reservoir 17. Elements that are not crucial for the understanding of the invention, such as pressure control valves, one-way restrictors, or the like, are not depicted.

The multiway valve 19 has seven openings in a row, T1, A1, P, B1, T2, A2, B2, which in this sequence are connected with reservoir 17, the inflow and outflow line 15 leading to the large swept volume, pump 18, the inflow and outflow line 16 leading to the lo small swept volume 14, reservoir 17, a connecting line 22 opening into line 15, and an additional connecting line 23 opening into inflow and outflow line 16, and which in the central position of valve piston 20 (zero position) shown in the drawing within the indicated valve housing pass into associated ring channels. These ring channels are blocked or open in the zero position by ring collars 21 formed on the valve piston 20 in a manner to be described below.

In the depicted zero position, connections A1, B1 and A2 are blocked by the three ring collars 21 of valve piston 20. If valve piston 20 is displaced toward the left, connections A1 and P on the one hand and A2 and B2 on the other hand are simultaneously unblocked or connected. Connection B1 continues to be blocked during displacement through the first path segment of valve piston 20 because overlap 25 of the associated ring collar 21 of valve piston 20 is effective over a correspondingly defined path segment. In this initially effective working position of valve piston 20, the pump pressurizes the large swept volume 13 of working cylinder 10 through connection A1 and inflow and outflow line 15. Since the area of piston 11 on the side of the large swept volume 13 is twice as large as on the opposite side, piston rod 12 extends and the oil displaced from the small swept volume 14 is directed through inflow and outflow line 16 and, with connection B1 still blocked, through connecting line 23 branching off therefrom while neutralizing the effect of non-return valve 24 to connection B2 of the multiway valve 19. From there it is supplied via open connection A2 and connecting line 22 of inflow and outflow line 15 to the large swept volume 13 such that pump 18 needs to deliver only half the quantity with respect to the large swept volume 13.

If piston rod 12 using the differential action of working cylinder 10 completes, for example, 90% of its forward motion, the associated control edge 6 of the allocated ring collar 21 of valve piston 20 unblocks the connection opening B1 as the valve piston 20 continues to shift toward the left to provide a link to reservoir connection T2. Thus the small swept volume 14 is directly connected to reservoir 17 through the inflow and outflow line 16 such that the pressure acting on the large area of piston 11 is not counteracted by a pressure in the small swept volume 14.

If valve piston 20 is displaced towards the right, it is also ensured that the delivery rate of pump 18 remains unchanged when the piston rod is retracted. On the supply side, this has the result of connecting connections P, B1 via inflow and outflow line 16 to the small swept volume 14, while the large swept volume 13 is connected with T1 via the inflow and outflow line 15 and connection A1, which is blocked against P, and with T2 via connecting line 22 branching off from line 15 and connection A2, such that a partitioning of the oil quantity flowing out of the large swept volume 13 results in this respect.

The characteristics of the subject of this document disclosed in the above specification, the claims, the abstract, and the drawing can be significant either individually or in any combination for the implementation of the invention in its various embodiments.

What is claimed is:

1. A controller for a double-acting fluid cylinder having a working piston movable in a forward direction by a first fluid volume, and in a rearward direction by a second fluid volume, said cylinder being operable by said controller under a source of fluid pressure having an associated fluid reservoir, and said controller comprising a multi-position flow control valve comprising:

a plurality of sequentially arranged fluid ports including a pressure port (P) coupled in fluid communication with said source of fluid pressure, a first reversing port (A1) coupled in fluid communication with said first fluid volume of said cylinder and couplable in fluid communication with said port P, a second reversing port (B1) coupled in fluid communication with said second fluid volume of said cylinder and couplable in fluid communication with said port P, a first reservoir port (T1) coupled in fluid communication with said reservoir and couplable in fluid communication with said port A1, a second reservoir port (T2) coupled in fluid communication with said reservoir and couplable in fluid communication with said port B1, a first by-pass port (A2) coupled in fluid communication with said first fluid volume of said cylinder, and a second by-pass port (B2) coupled in fluid communication with said second fluid volume of said cylinder and couplable in fluid communication with said port A2; and a valve positioner having a plurality of valve elements including, in series, a first valve element, a second valve element having a first control edge and a spaced-apart second control edge, and a third valve element, whereby said valve positioner is displaceable from a null position wherein said port A1 is blocked by said first valve element, said port B1 is blocked by said second valve element, and said port A2 is blocked by said third valve element, to a first control position wherein said first valve element is displaced from said port A1 opening said port A1 in fluid communication with said port P admitting fluid pressure to said first fluid volume of said cylinder moving said working piston in said forward direction, and said third valve element is displaced from said port A2 opening said port A2 in fluid communication with said port B2 admitting fluid displaced from said second fluid volume into said first fluid volume, said first control edge of said second valve element being spaced-apart from said second control edge such that said port B1 remains blocked by said second valve element when said valve positioner is disposed in said first control position.

2. The controller of claim 1 further comprising a check valve coupled in fluid communication with said second fluid volume of said cylinder and said port B2, said check valve delimiting the return of fluid to said second fluid volume when said valve positioner is disposed in said first control position.

3. The controller of claim 1 wherein said valve positioner is further displaceable from said first control position to a second control position wherein said second valve element is displaced from said port B1 opening said port B1 in fluid communication with said port T2 admitting fluid displaced from said second fluid volume into said reservoir.

4. The controller of claim 1 wherein said port A2 further is couplable in fluid communication with said port T2, and wherein said valve positioner further is displaceable from said null position to a third control position wherein said second valve element is displaced from said port B1 opening said port B1 in fluid communication with said port P admitting fluid pressure to said second fluid volume of said cylinder moving said working piston in said rearward direction, said first valve element is displaced from said port A1 opening said port A1 in fluid communication with said port T1 admitting a first partitioned quantity of fluid displaced from said first fluid volume into said reservoir, and said third valve element is displaced from said port A2 opening said port A2 in fluid communication with said port T2 admitting a second partitioned quantity of fluid displaced from said first fluid volume of said cylinder into said reservoir.

5. The controller of claim 1 wherein said control valve further comprises a valve channel, each of said fluid ports opening in linear succession into fluid communication with said valve channel, and said valve positioner being configured as a valve piston which is slidably received within said valve channel for linear movement from said first control position to said second control position.

6. The controller of claim 5 wherein said fluid ports are arranged successively in the order of T1, A1, P, B1, T2, A2, and B2.

7. The controller of claim 1 wherein said first fluid volume of said cylinder is larger than said second fluid volume.

8. The controller of claim 1 wherein said working piston of said cylinder defines a first area on the side of said first fluid volume and a second area on the side of said second fluid volume, said first area being larger than said second area.

9. A fluid power system comprising:

a double-acting fluid cylinder having a working piston movable in a forward direction by a first fluid volume, and in a rearward direction by a second fluid volume;

a fluid pressure source for providing working fluid pressure to said cylinder;

a fluid reservoir for supplying working fluid to said fluid pressure source; and a controller for operating said cylinder under said working fluid pressure, said controller comprising a multi-position flow control valve comprising:

a plurality of sequentially arranged fluid ports including a pressure port (P) coupled in fluid communication with said fluid pressure source, a first reversing port (A1) coupled in fluid communication with said first fluid volume of said cylinder and couplable in fluid communication with said port P, a second reversing port (B1) coupled in fluid communication with said second fluid volume of said cylinder and couplable in fluid communication with said port P, a first reservoir port (T1) coupled in fluid communication with said reservoir and couplable in fluid communication with said port A1, a second reservoir port (T2) coupled in fluid communication with said reservoir and couplable in fluid communication with said port B1, a first by-pass port (A2) coupled in fluid communication with said first fluid volume of said cylinder, and a second by-pass port (B2) coupled in fluid communication with said second fluid volume of said cylinder and couplable in fluid communication with said port A2; and a valve positioner having a plurality of valve elements including, in series, a first valve element, a second valve element having a first control edge and a spaced-apart second control edge, and a third valve element, whereby said valve positioner is displaceable from a null position wherein said port A1 is blocked by said first valve element, said port B1 is blocked by said second valve element, and said port A2 is blocked by said third valve element, to a first control position wherein said first valve element is displaced from said port A1 opening said port A1 in fluid communication with said port P admitting fluid pressure to said first fluid volume of said cylinder moving said working piston in said forward direction, and said third valve element is displaced from said port A2 opening said port A2 in fluid communication with said port B2 admitting fluid displaced from said second fluid volume into said first fluid volume, said first control edge of said second valve element being spaced-apart from said second control edge such that said port B1 remains blocked by said second valve element when said valve positioner is disposed in said first control position.

10. The fluid power system of claim 9 wherein said controller further comprises a check valve coupled in fluid communication with said second fluid volume of said cylinder and said port B2, said check valve delimiting the return of fluid to said second fluid volume when said valve positioner is disposed in said first control position.

11. The fluid power system of claim 9 wherein said valve positioner of said flow control valve is further displaceable from said first control position to a second control position wherein said second valve element is displaced from said port B1 opening said port B1 in fluid communication with said port T2 admitting fluid displaced from said second fluid volume into said reservoir.

12. The fluid power system of claim 9 wherein said port A2 of said flow control valve further is couplable in fluid communication with said port T2, and wherein said valve positioner of said flow control valve further is displaceable from said null position to a third control position wherein said second valve element is displaced from said port B1 opening said port B1 in fluid communication with said port P admitting fluid pressure to said second fluid volume of said cylinder moving said working piston in said rearward direction, said first valve element is displaced from said port A1 opening said port A1 in fluid communication with said port T1 admitting a first partitioned quantity of fluid displaced from said first fluid volume into said reservoir, and said third valve element is displaced from said port A2 opening said port A2 in fluid communication with said port T2 admitting a second partitioned quantity of fluid displaced from said first fluid volume of said cylinder into said reservoir.

13. The fluid power system of claim 9 wherein said control valve further comprises a valve channel, each of said fluid ports opening in linear succession into fluid communication with said valve channel, and said valve positioner being configured as a valve piston which is slidably received within said valve channel for linear movement from said first control position to said second control position.

14. The fluid power system of claim 13 wherein said fluid ports are arranged successively in the order of T1, A1, P, B1, T2, A2, and B2.

15. The fluid power system of claim 9 wherein said first fluid volume of said cylinder is larger than said second fluid volume.

16. The fluid power system of claim 9 wherein said working piston of said cylinder defines a first area on the side of said first fluid volume and a second area on the side of said second fluid volume, said first area being larger than said second area.

* * * * *